US010106955B2

(12) United States Patent
Shiratani et al.

(10) Patent No.: US 10,106,955 B2
(45) Date of Patent: Oct. 23, 2018

(54) TURNING CONTROL APPARATUS

(71) Applicant: SUMITOMO(S.H.I.) CONSTRUCTION MACHINERY CO., LTD., Tokyo (JP)

(72) Inventors: Ryuji Shiratani, Chiba (JP); Hideto Magaki, Chiba (JP); Minoru Okuyama, Chiba (JP); Masaaki Yamamoto, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 251 days.

(21) Appl. No.: 13/772,568

(22) Filed: Feb. 21, 2013

(65) Prior Publication Data

US 2013/0255243 A1 Oct. 3, 2013

(30) Foreign Application Priority Data

Mar. 30, 2012 (JP) ..... 2012-082871

(51) Int. Cl.
*E02F 9/12* (2006.01)
*F15B 13/00* (2006.01)
*E02F 9/22* (2006.01)

(52) U.S. Cl.
CPC ..... *E02F 9/128* (2013.01); *E02F 9/123* (2013.01); *E02F 9/2285* (2013.01); (Continued)

(58) Field of Classification Search
CPC ..... E02F 9/123–9/128; E02F 9/2214; F15B 21/047; F15B 2211/5154; F15B 2211/5159
See application file for complete search history.

(56) References Cited

U.S. PATENT DOCUMENTS 3,238,722 A * 3/1966 Berkman ..... E02F 9/123 60/414
4,644,849 A * 2/1987 Tanaka ..... F16H 61/4157 60/466

(Continued)

FOREIGN PATENT DOCUMENTS

EP 0537349 A1 4/1993
EP 0791753 A1 8/1997

(Continued)

OTHER PUBLICATIONS

JP2000266006A machine translation from espacenet. 2000.*

*Primary Examiner* — Dwayne J White
*Assistant Examiner* — Michael Quandt
(74) *Attorney, Agent, or Firm* — IPUSA, PLLC

(57) ABSTRACT

A turning control apparatus includes a turning body and a hydraulic motor to turn the turning body. A high-pressure relief circuit relieves hydraulic pressure of a first hydraulic line at a first relief pressure, the first hydraulic line supplying an operating oil to drive the hydraulic motor. A hunting reduction circuit relieves a hydraulic pressure of a second hydraulic line at a pressure lower than the first relief pressure, the second hydraulic line being connected to a deceleration-side hydraulic port from which the operating oil is discharged when the hydraulic motor is being driven. The hunting reduction circuit connected to the deceleration-side hydraulic port is caused to open before an operation lever to operate turning of the turning body returns to a neutral position.

7 Claims, 9 Drawing Sheets

(52) U.S. Cl.
CPC ..... *E02F 9/2289* (2013.01); *E02F 9/2296* (2013.01); *F15B 13/00* (2013.01)

(56) References Cited

U.S. PATENT DOCUMENTS

| | | | | | |
|---|---|---|---|---|---|
| 4,680,929 | A * | 7/1987 | Mouri | E02F 3/325 | 60/368 |
| 5,063,742 | A * | 11/1991 | Yoshimatsu | 60/466 | |
| 5,285,643 | A * | 2/1994 | Hirata | E02F 9/123 | 60/468 |
| 5,636,516 | A * | 6/1997 | Kon | 60/466 | |
| 6,732,513 | B2 * | 5/2004 | Tajima | 60/468 | |
| 7,392,653 | B2 * | 7/2008 | Sugano | 60/452 | |
| 7,841,360 | B2 * | 11/2010 | Bruck et al. | 137/625.68 | |
| 2011/0071738 | A1 * | 3/2011 | Kawasaki et al. | 701/50 | |
| 2012/0259497 | A1 | 10/2012 | Yamamoto et al. | | |

FOREIGN PATENT DOCUMENTS

| | | | | |
|---|---|---|---|---|
| JP | H05-040601 | U | | 6/1993 |
| JP | 06-018469 | U | | 3/1994 |
| JP | 2000266006 | A | * | 9/2000 |
| JP | 2011-144531 | | | 7/2011 |
| WO | WO2011/086888 | | * | 7/2011 |
| WO | WO2012/026264 | A1 | * | 3/2012 |

* cited by examiner

TURNING CONTROL APPARATUS

RELATED APPLICATION

This application is based upon and claims the benefit of priority of the prior Japanese Patent Application No. 2012-082871, filed on Mar. 30, 2012, the entire contents of which are incorporated herein by reference.

BACKGROUND

Technical Field

The present invention relates to a turning control apparatus to control a hydraulic turning mechanism provided in an operating machine such as a shovel.

Description of Related Art

It is suggested in an operating machine such as a shovel in which a turning mechanism, which is provided to turn, for example, an upper-part turning body, is driven by a hydraulic actuator. A hydraulic motor is used as a hydraulic actuator to drive the turning mechanism in many cases (for example, refer to Japanese Unexamined Utility Model Publication No. 06-18469).

Usually, a turning operation lever is used to turn a turning body by driving a turning mechanism. When an operator tilts a turning operation lever, which is provided in a driver's seat, in a turning direction, hydraulic pressure is supplied to a turning hydraulic motor, which results in driving the turning mechanism. When the operator returns the turning operation lever to a neutral position, the supply of hydraulic pressure to the turning hydraulic motor is stopped. Thereby, braking is applied by the turning hydraulic motor and the turning motion by the turning mechanism is decelerated.

SUMMARY

There is provided a turning control apparatus including: a turning body; a hydraulic motor to turn the turning body; a high-pressure relief circuit that relieves a hydraulic pressure of a first hydraulic line at a first relief pressure, the first hydraulic line supplying an operating oil to drive the hydraulic motor; and a hunting reduction circuit that relieves a hydraulic pressure of a second hydraulic line at a pressure lower than the first relief pressure, the second hydraulic line being connected to a deceleration-side hydraulic port from which the operating oil is discharged when the hydraulic motor is being driven, wherein the hunting reduction circuit connected to the deceleration-side hydraulic port is caused to open before an operation lever to operate turning of the turning body returns to a neutral position.

It is to be understood that both the foregoing general description and the following detailed description are exemplary explanatory only and are not restrictive of the invention, as claimed.

DETAILED DESCRIPTION

The above-mentioned Japanese Unexamined Utility Model Publication No. 06-18469 suggests preventing a backlash from being generated in the turning body due to braking when the turning operation lever is returned to a neutral position. However, actually the turning body has already been decelerated by an action of the turning operation lever toward the neutral position. That is, the turning body has already been set in a decelerating state before the turning operation lever reaches the neutral position. Thereby, a hunting phenomenon may occur with respect to the turning body in the decelerating state before the turning operation lever returns to the neutral position.

Accordingly, it is desirable to provide a turning control apparatus which can suppress a vibration of a turning body generated during a decelerating operation of the turning body.

More specifically, it is desirable to relieve a hydraulic pressure momentarily generated at a hydraulic port on a deceleration side of the turning hydraulic motor at the time of deceleration of the turning body by a hunting reduction circuit, thereby suppressing a rapid fluctuation in the deceleration by the turning hydraulic motor to suppress vibration of the turning body generated at the time of large deceleration.

Figure 1:
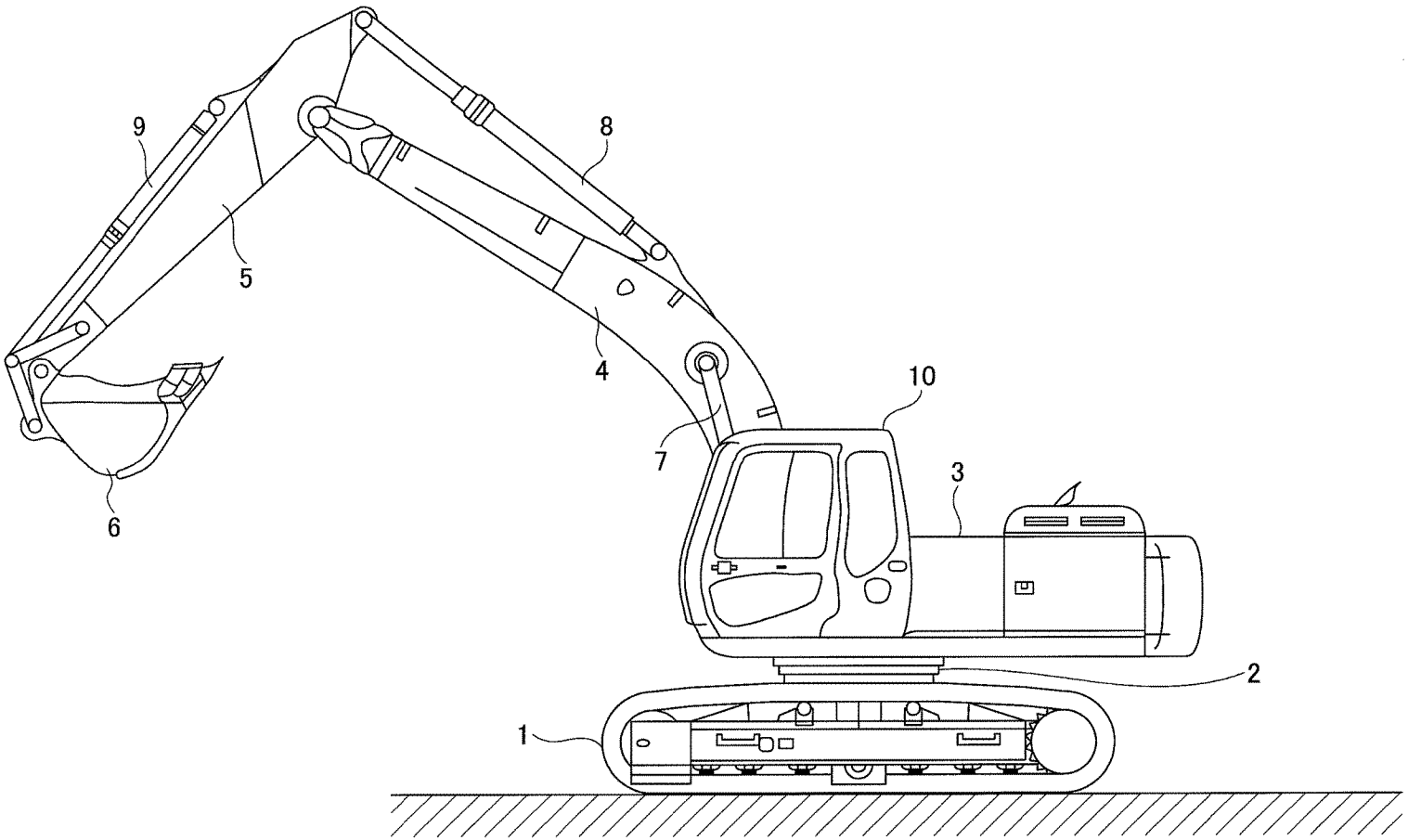
FIG. 1 is a side view of a shovel incorporating a turning control apparatus according to one example.

FIG. 1 is a side view illustrating a shovel incorporating a turning control apparatus according to one example.

An upper turning-body 3 is mounted in a lower running-body 1 of the shovel via a turning mechanism 2. A boom 4 is attached to the upper turning-body 3. An arm 5 is attached at an end of the boom 4, and a bucket 6 is attached at an end of the arm 5. The boom 4, the arm 5, and the bucket 6 are hydraulically driven by a boom cylinder 7, an arm cylinder 8, and a bucket cylinder 9, respectively. The upper turning-body 3 is provided with a cabin 10. A power source such as an engine or the like is also mounted in the upper turning-body.

Figure 2:
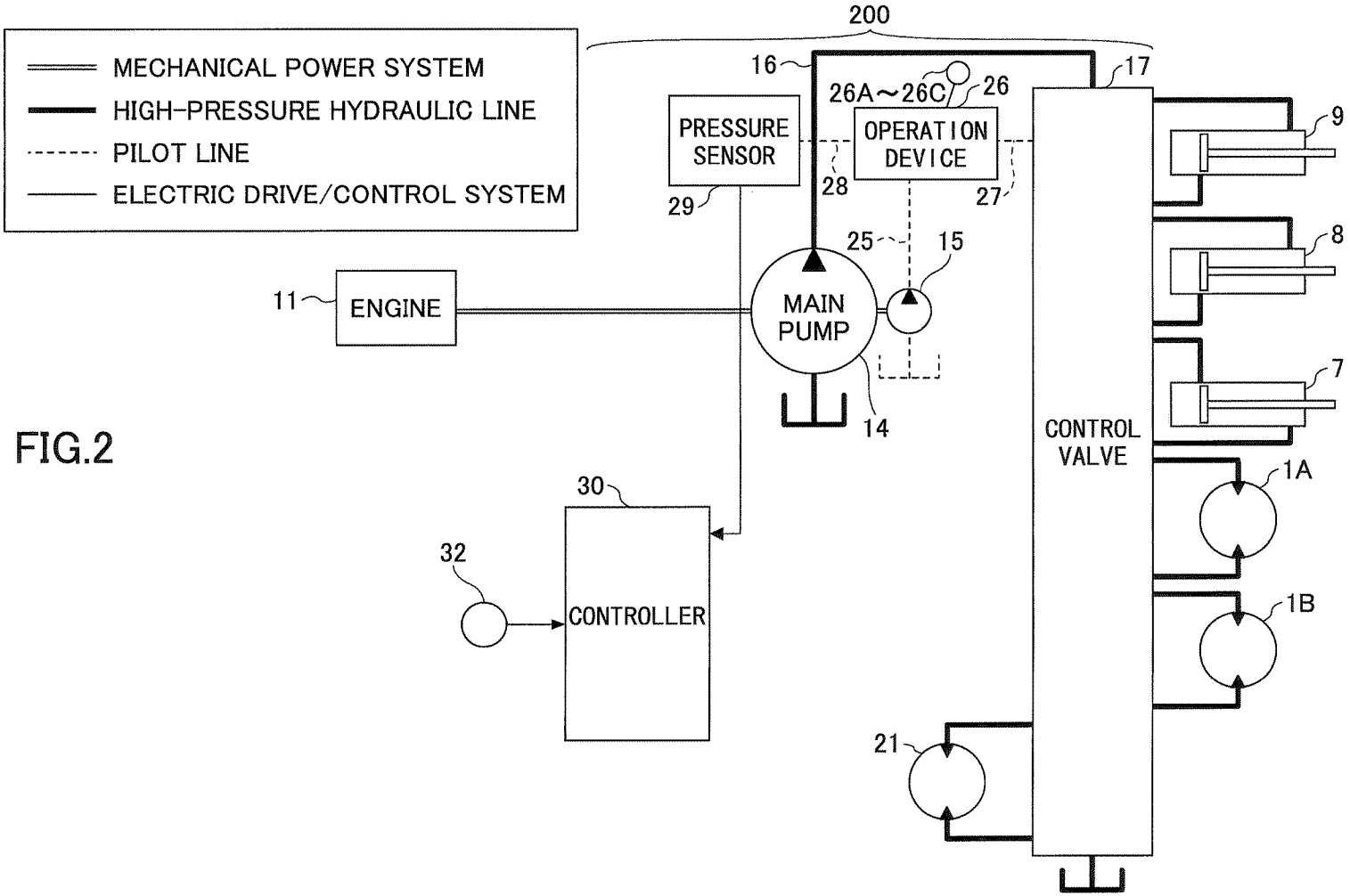
FIG. 2 is a block diagram of a drive system of the shovel illustrated in FIG. 1.

FIG. 2 is a block diagram illustrating a structure of a drive system of the shovel illustrated in FIG. 1. In FIG. 2, a mechanical power transmission lines are indicated by double lines, high-pressure hydraulic lines are indicated by heavy lines, pilot pressure lines are indicated by dashed lines, and electric drive/control lines are indicated by thin lines.

An engine 11 as a mechanical drive part is connected to a main pump 14 and a pilot pump 15, which are hydraulic pumps. A control valve 17 is connected to the main pump 14 through a high-pressure hydraulic line 16.

The control valve 17 is a control apparatus, which controls a hydraulic system in the shovel. Running hydraulic motors 1A (right) and 1B (left) of the lower running-body 3, the boom cylinder 7, the arm cylinder 8, and the bucket cylinder 9 are connected to the control valve 17 through high-pressure hydraulic lines.

Moreover, a turning hydraulic motor 21 for driving the turning mechanism 2 is connected to the control valve 17. Although the turning hydraulic motor 21 is connected to the control valve 17 through a hydraulic circuit of the turning control apparatus, the hydraulic circuit of the turning control apparatus is not illustrated in FIG. 2. A turning hydraulic apparatus including the hydraulic circuit will be explained later.

An operation apparatus 26 is connected to the pilot pump 15 through a pilot line 25. The operation apparatus 26 includes levers 26A and 26B and a pedal 26C. The levers 26A and 26B and the pedal 26C are connected to the control valve 17 and a pressure sensor 29 through hydraulic lines 27 and 28, respectively. The pressure sensor 29 is connected to a controller 30, which performs a drive control of an electric system. In the present example, the lever 26A serves as a turning operation lever.

The controller 30 is a control apparatus serving as a main control part, which performs a drive control of the shovel. The controller 30 is an arithmetic processing device including a CPU (central processing unit) and an internal memory. The controller 30 is realized by the CPU executing a drive control program stored in the internal memory.

An inclination sensor 32 is provided in the upper turning-body 3 to detect an inclination angle of the shovel. When the shovel is installed on a sloping ground, the inclination sensor 32 supplies a signal indicating an inclination angle of the shovel to the controller 30. The inclination sensor 32 may be provided in the lower running-body 1 instead of the upper turning-body 3.

A description is given below of the turning control apparatus, which controls driving of the turning hydraulic motor 21. The turning control apparatus includes a turning hydraulic circuit for driving the turning hydraulic motor 21. The turning hydraulic circuit is provided between the turning hydraulic motor 21 and the control valve 17.

Figure 3:
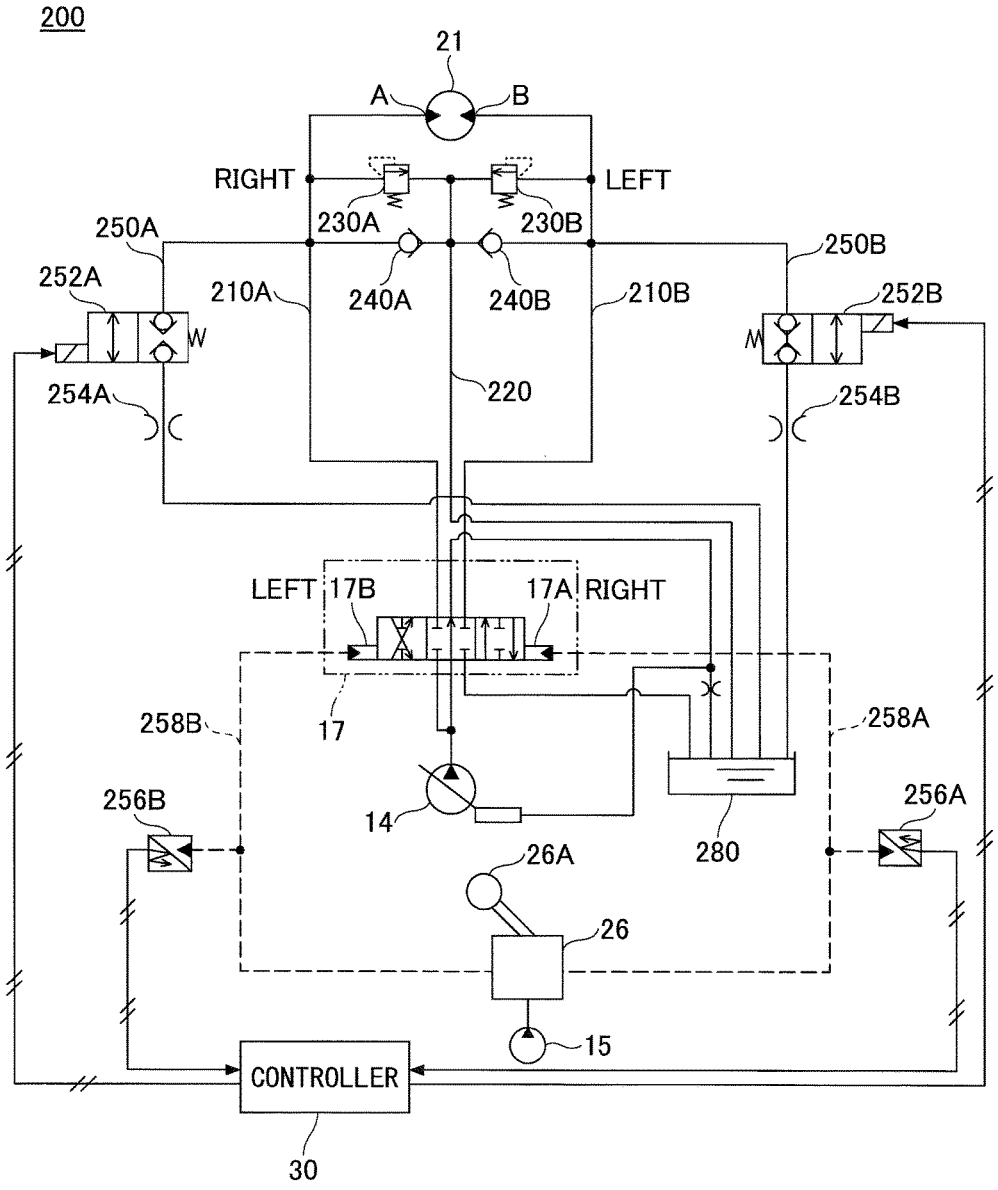
FIG. 3 is a hydraulic circuit diagram of a turning control apparatus according to the example.

FIG. 3 illustrates a hydraulic circuit of the turning control apparatus 200. First, the turning drive hydraulic circuit for driving the turning hydraulic motor 21 will be explained. In FIG. 3, the turning drive hydraulic circuit is a hydraulic circuit provided between the turning hydraulic motor 21 and the control valve 17. The turning drive hydraulic circuit includes a hydraulic line 210A, a hydraulic line 210B, and a makeup hydraulic line 220. The hydraulic line 210A connects an A-port of the turning hydraulic motor to the control valve 17. The hydraulic line 210B connects a B-port of the turning hydraulic motor to the control valve 17. The makeup hydraulic line 220 connects the hydraulic lines 210A and 210B to a tank 280.

A high-pressure relief valve 230A is provided between the hydraulic line 210A and the makeup hydraulic line 220. If a hydraulic pressure of the hydraulic line 210A (that is, a hydraulic pressure at the A-port of the turning hydraulic motor 21) becomes equal to or higher than a relief pressure of the high-pressure relief valve 230A, a high-pressure operating oil flows from the hydraulic line 210A to the makeup hydraulic line 220 through the high-pressure relief valve 230A. Thus, the pressure of the operating fluid is reduced to a low pressure, and is returned to the tank 280. The high-pressure relief valve 230A and the makeup hydraulic line 220 together constitute a high-pressure relief circuit.

A check valve 240A is provided between the hydraulic line 210A and the makeup hydraulic line 220. If a hydraulic pressure of the hydraulic line 210A (that is, a hydraulic pressure at the A-port of the turning hydraulic motor 21) becomes equal to or lower than a predetermined hydraulic pressure (makeup hydraulic pressure), the operating oil in the tank 280 flows into the hydraulic line 210A through the makeup hydraulic line 220 and the check valve 240A. Thereby, the operating oil of the hydraulic line 210A (that is, a hydraulic pressure at the A-port of the turning hydraulic motor 21) is made up by the operating oil from the makeup hydraulic line 220.

Similarly, a high-pressure relief valve 230B is provided between the hydraulic line 210B and the makeup hydraulic line 220. If a hydraulic pressure of the hydraulic line 210B (that is, a hydraulic pressure at the B-port of the turning hydraulic motor 21) becomes equal to or higher than a relief pressure of the high-pressure relief valve 230B, a high-pressure operating oil flows from the hydraulic line 210B to the makeup hydraulic line 220 through the high-pressure relief valve 230B. Thus, the pressure of the operating fluid is reduced to a low pressure, and is returned to the tank 280. The high-pressure relief valve 230B and the makeup hydraulic line 220 together constitute a high-pressure relief circuit.

A check valve 240B is provided between the hydraulic line 210B and the makeup hydraulic line 220. If a hydraulic pressure of the hydraulic line 210B (that is, a hydraulic pressure at the B-port of the turning hydraulic motor 21) becomes equal to or lower than a predetermined hydraulic pressure (makeup hydraulic pressure), the operating oil in the tank 280 flows into the hydraulic line 210B through the makeup hydraulic line 220 and the check valve 240B. Thereby, the operating oil of the hydraulic line 210B (that is, a hydraulic pressure at the B-port of the turning hydraulic motor 21) is made up by the operating oil from the makeup hydraulic line 220.

The high-pressure operating oil discharged from the main pump 14 is supplied to the control valve 17, and is then supplied to the hydraulic line 210A or the hydraulic line 210B from the control valve 17. If the control valve 17 is operated so that the high-pressure operating oil is supplied to the hydraulic line 210A, the hydraulic line 210B is connected to the tank 280. Accordingly, the high-pressure operating oil is supplied to the A-port of the turning hydraulic motor 21. The high-pressure operating oil supplied to the A-port drives the turning hydraulic motor 21, and the pressure thereof becomes low. Then, the low-pressure operating oil is returned to the tank 280. The turning mechanism 2 is driven by the turning hydraulic motor 21 being driven, which results in turning of the upper turning-body 3. The turning at this time is assumed to be turning in the rightward direction. That is, when a hydraulic pressure is supplied to the A-port of the turning hydraulic motor 21, the upper turning-body 3 turns in the rightward direction.

On the other hand, if the control valve 17 is operated so that the high-pressure operating oil is supplied to the hydraulic line 210B, the hydraulic line 210A is connected to the tank 280. Accordingly, the high-pressure operating oil is supplied to the B-port of the turning hydraulic motor 21. The high-pressure operating oil supplied to the B-port drives the turning hydraulic motor 21, and the pressure thereof becomes low. Then, the low-pressure operating oil is returned to the tank 280. When the turning hydraulic motor 21 turns, this drives the turning mechanism 2 and turns the upper turning-body 3. The turning at this time is assumed to be turning in the leftward direction. That is, when a hydraulic pressure is supplied to the B-port of the turning hydraulic motor 21, the upper turning-body 3 turns in the leftward direction.

The control valve 17 is operated by a pilot pressure supplied from the operation apparatus 26. A hydraulic pressure is supplied to the operation apparatus 26 from the pilot pump 15. The operation apparatus 26 creates the pilot pressure for operating the control valve 17 using the hydraulic pressure supplied by the pilot pump 15.

That is, if the operator tilts the turning operation lever 26A of the operation apparatus 26 toward the right side in order to cause the upper turning-body 3 to turn in the rightward direction, the operation apparatus 26 supplies a pilot pressure to a control port 17A on the right end side of the control valve 17. The control valve 17 is operated by the pilot pressure, and, thereby, a state is set where the hydraulic line 210A is connected to the main pump 14 and the hydraulic line 210B is connected to the tank 280.

On the other hand, if the operator tilts the turning operation lever 26A of the operation apparatus 26 toward the left side in order to cause the upper turning-body 3 to turn in the leftward direction, the operation apparatus 26 supplies a pilot pressure to a control port 17B on the left side of the control valve 17. The control valve 17 is operated by the pilot pressure, and, thereby, a state is set where the hydraulic line 210B is connected to the main pump 14 and the hydraulic line 210A is connected to the tank 280.

The above-mentioned structure is the structure of the turning drive apparatus 200, which drives and controls the turning hydraulic motor 21 for turning the upper turning-body 3. In addition to the above-mentioned structure, a structure of suppressing a hunting phenomenon which occurs when decelerating the turning hydraulic motor 21 is provided in the present example.

The structure of suppressing the hunting phenomenon includes a hydraulic line 250A, which connects the hydraulic line 210A to the tank 280, and a hydraulic line 250B, which connects the hydraulic line 210B to the tank 280. An open/close valve 252A and an orifice 254A are provided in the hydraulic line 250A. An open/close valve 252B and an orifice 254B are provided in the hydraulic line 250B.

The open/close valves 252A and 252B are operated by signals supplied from the controller 30. A switch 256A, which converts the pilot pressure supplied from the operation apparatus 26 to the control port 17A, is connected to a pilot line 258A, which connects the operation apparatus 26 to the control port 17A of the control valve 17. Similarly, a switch 256B, which converts the pilot pressure supplied from the operation apparatus 26 to the control port 17B, is connected to a pilot line 258B, which connects the operation apparatus 26 to the control port 17B of the control valve 17.

When a pilot pressure is supplied from the operation apparatus 26 to the control port 17A of the control valve 17, the switch 256A detects the pilot pressure and supplies a detection signal (electric signal) to the controller 30. When the detection signal is supplied from the switch 256A, the controller 30 controls the open/close valve 252A to close and the open/close valve 252B to open.

That is, when the operator tilts the turning operation lever 26A toward the right side in order to cause the upper turning-body 3 to turn in the rightward direction, the operation apparatus 26 supplies a pilot pressure to the control port 17A on the right end side of the control valve 17, and, thus, the switch 256A sends a detection signal to the controller 30. Thereby, the controller 30 causes the open/close valve 252A to close and the open/close valve 252B to open. At this time, because the open/close valve 252A is closed, the high-pressure operating oil from the control valve 17 does not flow to the hydraulic line 250A but is supplied to the A-port of the turning hydraulic motor 21 by passing through the hydraulic line 210A. The operating oil supplied to the A-port cause the turning hydraulic motor 21 to drive, and is discharged from the B-port and flows through the hydraulic line 210B to return to the tank 280.

As mentioned above, the hydraulic line 250B, the open/close valve 252B, and the orifice 254B together constitute a hunting reduction circuit.

Similarly, when a pilot pressure is supplied from the operation apparatus 26 to the control port 17B of the control valve 17, the switch 256B detects the pilot pressure and supplies a detection signal (electric signal) to the controller 30. When the detection signal is supplied from the switch 256B, the controller 30 controls the open/close valve 252B to close and the open/close valve 252A to open.

That is, when the operator tilts the turning operation lever 26A toward the left side in order to cause the upper turning-body 3 to turn in the leftward direction, the operation apparatus 26 supplies a pilot pressure to the control port 17B on the left end side of the control valve 17, and, thus, the switch 256B sends a detection signal to the controller 30. Thereby, the controller 30 causes the open/close valve 252B to close and the open/close valve 252A to open. At this time, because the open/close valve 252B is closed, the high-pressure operating oil from the control valve 17 does not flow to the hydraulic line 250B but is supplied to the B-port of the turning hydraulic motor 21 by passing through the hydraulic line 210B. The operating oil supplied to the B-port cause the turning hydraulic motor 21 to drive, and is discharged from the A-port and flows through the hydraulic line 210A to return to the tank 280. At this time, because the hydraulic line 210A connected to the A-port is connected to the hydraulic line 250A and the open-close valve 252A is open, a portion of the operating oil discharged from the A-port can return to the tank 280 by routing the hydraulic line 250A.

As mentioned above, the hydraulic line 250A, the open/close valve 252A, and the orifice 254A together constitute a hunting reducing circuit.

A description will be given below of an operation when a rapid turning deceleration is carried out because of rapid returning of the turning operation lever 26A toward the neutral position in the turning control apparatus 200 incorporating a hydraulic circuit having the above-mentioned structure.

Figure 4A:
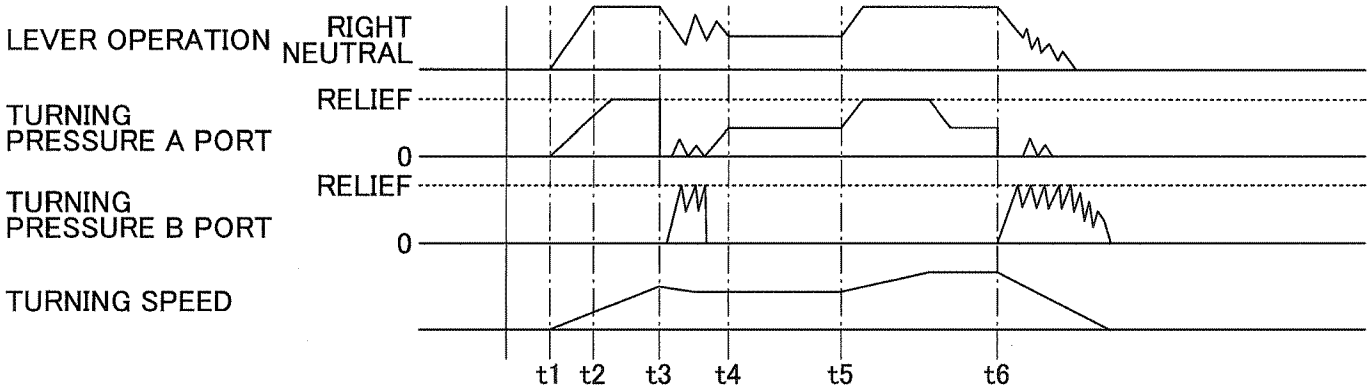
FIG.4A RELATED ART
FIGS. 4A and 4B are time charts indicating hydraulic pressure changes at a turning hydraulic motor when turning of an upper turning-body is decelerated and stopped.

For the sake of comparison, a description is given first, with reference to FIG. 4A, of a case where no structure to suppress hunting phenomenon, which occurs when decelerating the turning hydraulic motor 21, is provided. FIG. 4A is a time chart indicating changes in hydraulic pressure in the turning hydraulic motor 21 when the upper turning-body 3 is decelerated in turning motion and is stopped.

When the turning operation lever 26A is tilted toward the right turning direction at a time t1, a supply of hydraulic pressure to the A-port of the turning hydraulic motor 21 is started. Thereby, the hydraulic pressure at the hydraulic line 210A (A-port) starts to rise. At this time, the A-port of the turning hydraulic motor 21 is set as an acceleration-side hydraulic port. An operation amount of the turning operation lever 26A becomes maximum at a time t2 (a state where the turning operation lever 26A is tilted at maximum toward the right side), and, thereafter, the maximum operation amount is maintained. At this time, the hydraulic pressure at the A-port of the turning hydraulic motor 21 starts to rise at the time t1, and reaches at a constant value after the time t2 is passed. The hydraulic pressure at the A-port becomes constant because the hydraulic pressure of the hydraulic line 210A reaches the relief pressure of the high-pressure relief valve 230A. That is, the upper limit of the hydraulic pressure supplied to the A-port of the turning hydraulic motor 21 is determined by the high-pressure relief valve 230A.

Because the hydraulic pressure is supplied to the A-port of the turning hydraulic motor 21, the turning hydraulic motor 21 is driven by the hydraulic pressure. Thereby, the upper turning-body 3 starts to turn right. The turning speed is continuously increased even after the time t2 is passed and until a time t3 is reached.

Here, at the time t3, the driver performs an operation to return the turning operation lever 26A to a half position in order to decelerate the turning of the upper turning-body 3 as the driver considers that the desired turning speed is reached. Here, the half position indicates a middle position between the maximum operation amount and the neutral position. Then, the supply of hydraulic pressure to the hydraulic line 210A is stopped, and the hydraulic pressure to the A-port of the turning hydraulic motor 21 rapidly decreases and becomes zero. At this time, even if the supply of hydraulic pressure to the A-port is stopped at the time t3, the hydraulic pressure at the A-port becomes lower than the makeup hydraulic pressure because the turning hydraulic motor 21 is caused to rotate due to an inertia force of the upper turning-body 3. Thereby, the operating oil inside the tank 280 and the operating oil passed through the high-pressure relief valve 230B are caused to flow into the hydraulic line 210A through the makeup hydraulic line 220 and the check valve 240A, and supplied to the A-port of the turning hydraulic motor 21.

Because the operating oil is discharged from the B-port of the turning hydraulic motor 21, the hydraulic pressure at the B-port rapidly rises at the time t3. The B-port of the turning hydraulic motor 21 at this time is set as a deceleration-side hydraulic port (brake-side hydraulic port). According to the rising of the hydraulic pressure at the B-port, braking is applied to the upper turning-body 3 by the turning hydraulic motor 21, and the acceleration of the upper turning-body 3 is stopped. At this time, because the hydraulic line 210B is blocked off, the hydraulic pressure at the B-port of the turning hydraulic motor 21 and inside the hydraulic line 210B rises rapidly and reaches the relief pressure of the high-pressure relief valve 230B.

However, because the operation amount of the turning operation lever 26A operated by the driver fluctuates largely during a time period between the time t3 and the time t4 as illustrated in FIG. 4A, the hydraulic pressure, which once reached zero, again repeatedly rises and falls at the A-port of the turning hydraulic motor 21. Moreover, the hydraulic pressure at the B-port of the turning hydraulic motor 21 also largely fluctuates in the period between the time t3 and the time t4. That is, the hydraulic pressure at the B-port starts to sharply rise at the time t3 and, then, reaches the relief pressure of the high-pressure relief valve 230A, and, thereafter, the turning operation lever 26A deflects in an accelerating direction. Therefore, the turning of the upper turning-body 3 is set again in the accelerating state, which results in sharp falling in the hydraulic pressure at the B-port.

Then, because the turning operation lever 26A is operated again toward the neutral position, the decelerating state is set again, which results in a sharp increase in the hydraulic pressure at the B-port. Due to the fluctuation in the hydraulic pressure at the B-port, a small shock or vibration occurs as a hunting phenomenon in the turning motion of the upper turning-body 3.

When the fluctuation in the operation amount of the turning operation lever 26A is eliminated at a time t4, the hydraulic pressure at the A-port of the turning hydraulic motor 21 is determined by the operation amount (amount of tilt) of the turning operation lever 26A. Thereafter, the turning hydraulic motor 21 rotates at a uniform speed, and the upper turning-body 3 continues to turn at a turning speed corresponding to the operation by the driver.

Then, at a time t5, the driver starts to operate the turning operation lever 26A again to tilt at maximum toward the right side, and, thus, the operation amount of the turning operation lever 26A increases again to the maximum operation amount. Thereby, the hydraulic pressure supplied to the A-port of the turning hydraulic motor 21 is increased, and reaches and maintained at the relief pressure of the high-pressure relief valve 230A.

Then, at a time t6, the driver starts to return the turning operation lever 26A to the neutral position in order to stop turning of the upper turning-body 3. Thus, the hydraulic pressure supplied to the A-port of the turning hydraulic motor 21 falls rapidly, and, simultaneously, the hydraulic pressure at the B-port rapidly rises. Due to the rapid rising of the hydraulic pressure at the B-port, large braking is applied to the turning hydraulic motor 21 and the upper turning-body 3 decelerates rapidly. Due to the rapid deceleration of the upper turning-body 3, the above-mentioned hunting phenomenon occurs. Thus, the hydraulic pressure at the B-port of the turning hydraulic motor 21 fluctuates largely, which generates a vibration in the upper turning-body 3.

As mentioned above, when the upper turning-body 3 is rapidly decelerated, an amount of operation of the turning operation lever 26A by the driver fluctuates, thereby generating a hunting phenomenon resulting in a vibration generated in the upper turning-body 3. In the present example, in order to suppress the occurrence of the hunting phenomenon, the hydraulic line 250A, which includes the open/close valve 252A and the orifice 254A, is connected to the hydraulic line 210A for supplying hydraulic pressure to the A-port of the turning hydraulic motor 21, and the hydraulic line 250B, which includes the open/close valve 252B and the orifice 254B, is connected to the hydraulic line 210B for supplying hydraulic pressure to the B-port of the turning hydraulic motor 21.

Figure 4B:
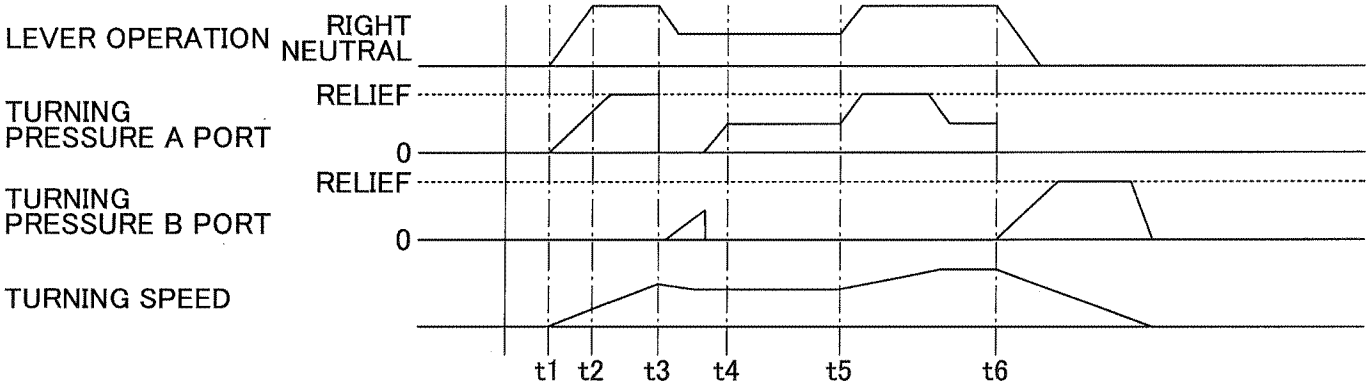

FIG. 4B is a time chart indicating changes in the hydraulic pressure in the turning hydraulic motor 21 when the turning control apparatus 200 is provided in the shovel and when the driver performs an operation the same as the operation of the turning operation lever 26A as illustrated in FIG. 4A.

Although the action and operation at each time t1 through t6 are the same as the action and operation illustrated in FIG. 4A, occurrence of the hunting phenomenon is suppressed in the example illustrated in FIG. 4B. When a rapid deceleration of the upper turning body 3 is performed at the time t3, the hydraulic pressure at the B-port of the turning hydraulic motor 21 rises but limited at a fixed pressure by the low-pressure relief pressure.

That is, the switch 256A detects pilot pressure supplied from the turning operation lever 26A to the control port 17A of the control valve 17 at the time t3, and sends the detection signal to the controller 30. Upon receipt of the detection signal, the controller 30 controls the open/close valve 252B to open. Thereby, the operating oil discharged from the B-port of the turning hydraulic motor 21 flows to the tank 280 by flowing through the hydraulic line 210B. However, because the orifice 254B, which provides a predetermined flow resistance, is arranged in the middle of the hydraulic line 210B, the pressure of the operating oil discharged from the B-port of the turning hydraulic motor 21 after the time t3 rises at a certain degree. This hydraulic pressure causes an appropriate brake force to be generated, and there is no rapid braking being applied by the turning hydraulic motor 21. Accordingly, there is no excessively rapid deceleration being applied to the upper turning-body 3 and it is not a deceleration which affects the driver's operation of the turning operation lever 26A. Thus, occurrence of the hunting phenomenon is suppressed.

The changes in the hydraulic pressure at the B-port of the turning hydraulic motor 21 at the time t6 of stopping turning are the same as the changes in the hydraulic pressure at the B-port after the time t3. When the state of turning at a constant speed is changed into the state of turning of deceleration, the control valve 17 is controlled to narrow down the hydraulic line 210 in response to a change in the pilot pressure, and the controller 30 controls the open/close valve 252B to open. Thereby, the operating oil discharged from the B-port returns to the tank 280 by passing through the orifice 254B, and, thus, the hydraulic pressure at the B-port does not rise rapidly. After the time t6, the hydraulic pressure at the B-port moderately rises after the time t6, and then reaches the relief pressure of the high-pressure relief valve 230B and is maintained at the relief pressure. Thereafter, when the rotation speed of the turning hydraulic motor 21 is decreased, the hydraulic pressure at the B-port falls and becomes zero when the upper turning-body 3 stops turning. As mentioned above, there is no rapid deceleration when the turning is stopped after the time t6, and it is not a deceleration of such a degree that the driver's inertia affects the operation of the turning operation lever 26A. As mentioned above, when the state of turning in acceleration is changed into the state of turning at a constant speed or when the state of turning at a constant speed is changed into the state of turning in deceleration, the hunting phenomenon is suppressed from occurring by operating the control valve 17. Specifically, the control valve 17 narrows down the hydraulic line on the deceleration side in response to a change in the pilot pressure and the controller 30 controlling the hunting reduction circuit on the deceleration side to open. Moreover, the same control may be applied in a case where the state of turning in acceleration is changed into the state of turning in deceleration.

Figure 5:
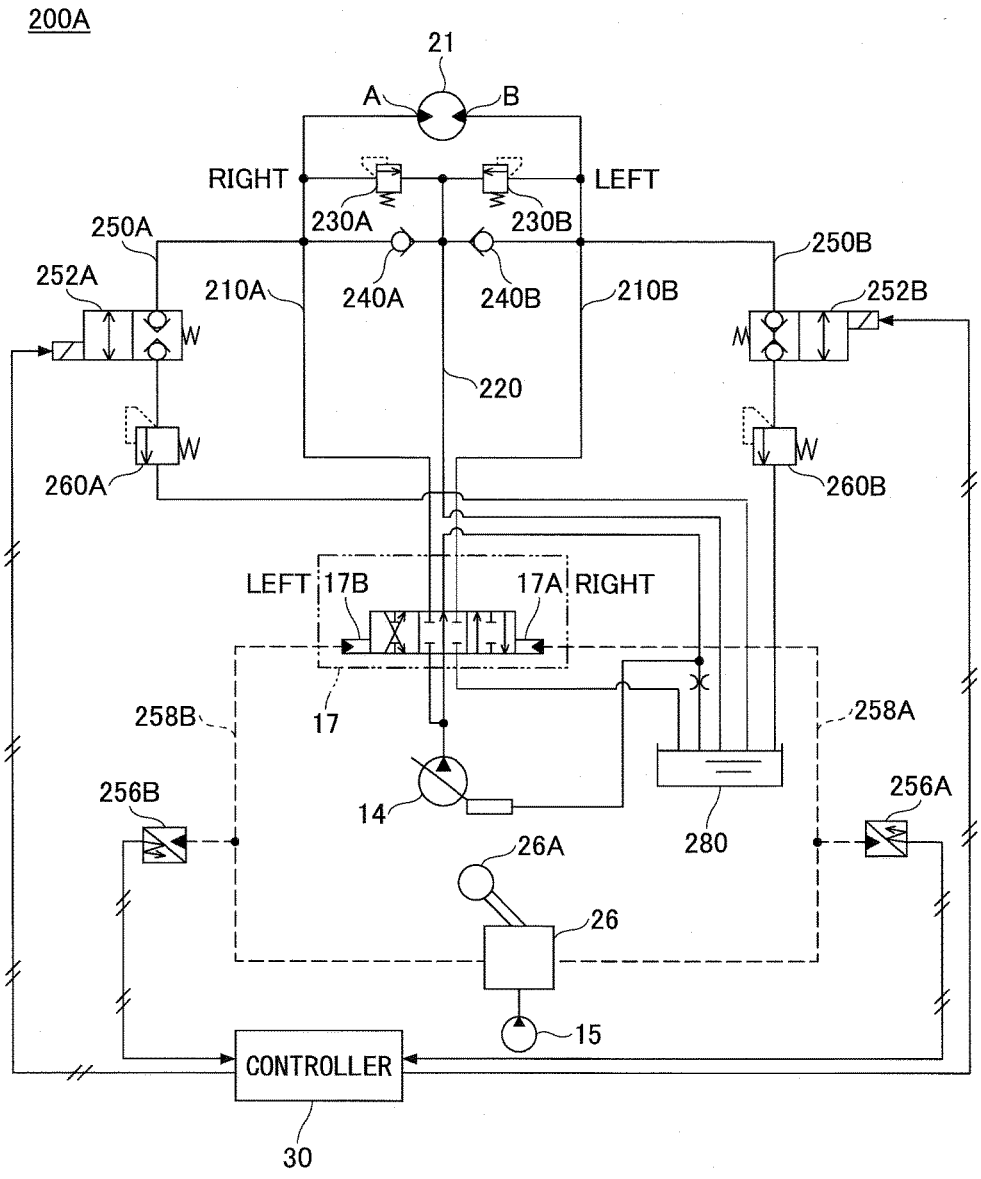
FIG. 5 is a hydraulic circuit diagram of a turning control apparatus according to another example.

A description will be given below, with reference to FIG. 5, of a turning control apparatus 200A according to another example. FIG. 5 is a circuit diagram of a hydraulic circuit of the turning control apparatus 200A.

In the turning control apparatus 200A illustrated in FIG. 5, the orifices 254A and 254B in the turning control apparatus 200 illustrated in FIG. 3 are replaced by low-pressure relief valves 260A and 260B, respectively. Thus, in FIG. 5, parts that are the same as the parts illustrated in FIG. 3 are given the same reference numerals, and descriptions thereof will be omitted.

In the present example, the operating oil discharged from the B-port of the turning hydraulic motor 21 when performing right-turn deceleration is returned to the tank 280 through the low-pressure relief valve 260B. That is, the function of returning the operating oil to the tank 280 while causing the hydraulic pressure at the B-port to rise with a certain degree at the time of deceleration is achieved by the low-pressure relief valve 260B instead of the orifice 254B. Accordingly, in this example, the hydraulic line 250B, the open/close valve 252B and the low-pressure relief valve 260B together constitute a hunting reduction circuit. Similarly, the hydraulic line 250A, the open/close valve 252A and the low-pressure relief valve 260A together constitute another hunting reduction circuit.

Figure 6:
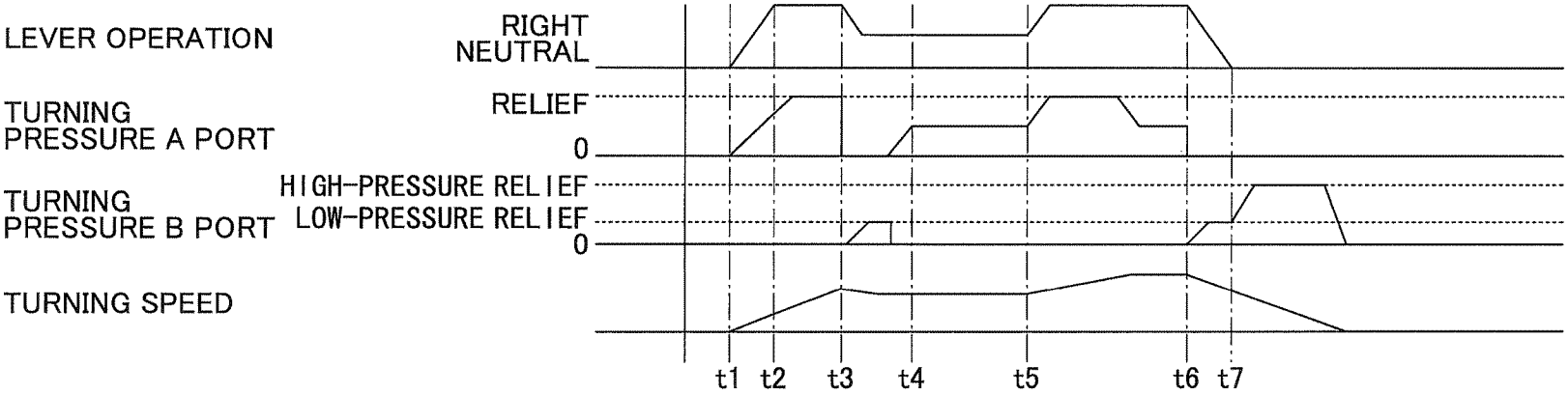
FIG. 6 is a time chart indicating hydraulic pressure changes at a turning hydraulic motor when an operator performs the same operation as the operation of a turning operation lever illustrated in FIG. 4A in a case where the turning control apparatus according to the another example is provided.

FIG. 6 is a time chart indicating changes in the hydraulic pressure in the turning hydraulic motor 21 in a case where the driver performs an operation the same as the operation of the turning operation lever 26A illustrated in FIG. 4A when the turning control apparatus 200A is provided in the shovel.

Although the action and operation at each time t1 through t6 are the same as the action and operation illustrated in FIG. 4A, the hunting phenomenon is suppressed from occurring in the example illustrated in FIG. 6. When a rapid deceleration of the upper turning-body 3 is performed, the hydraulic pressure at the B-port of the turning hydraulic motor 21 rises but is maintained constant at the low-pressure relief pressure after the time when the hydraulic pressure at the B-port exceeds the relief pressure of the low-pressure relief valve 260B.

That is, even if the open/close valve 252B is open at the time t3, the operating oil does not return to the tank 280 through the hydraulic line 250B until the hydraulic pressure at the B-port reaches the relief pressure of the low-pressure relief valve 260B, and the hydraulic pressure at the B-port (hydraulic pressure inside the hydraulic line 210B) rises rapidly. However, when the hydraulic pressure at the B-port (hydraulic pressure inside the hydraulic line 210B reaches the relief pressure of the low-pressure relief valve 260B, a portion of the operating oil discharged from the B-port can return to the tank 280 by flowing through the hydraulic line 250B and the low-pressure relief valve 260B. Similar to the above-mentioned orifice 254B, the low-pressure relief valve 260B has a predetermined flow resistance. Thereby, the rising of the hydraulic pressure at the B-port is suppressed, and a rapid deceleration is suppressed and the occurrence of the hunting phenomenon is suppressed.

Turning deceleration the same as the turning deceleration after the time t3 is performed also after the time t6. Thus, the rising of the hydraulic pressure at the B-port is suppressed, and a rapid deceleration is suppressed and the occurrence of the hunting phenomenon is suppressed.

When the turning operation lever 26A is returned to the neutral position at a time t7, the open/close valve 252B is closed because no signal is supplied to the open/close valve 252B. Thereby, the operating oil does not flow to the low-pressure relief valve 260B, and the low-pressure relief function does not act to the hydraulic pressure at the B-port. Accordingly, the hydraulic pressure at the B-port rises from the low-pressure relief pressure and reaches the high-pressure relief pressure. Thus, a vibration is suppressed when stopping turning.

Figure 7:
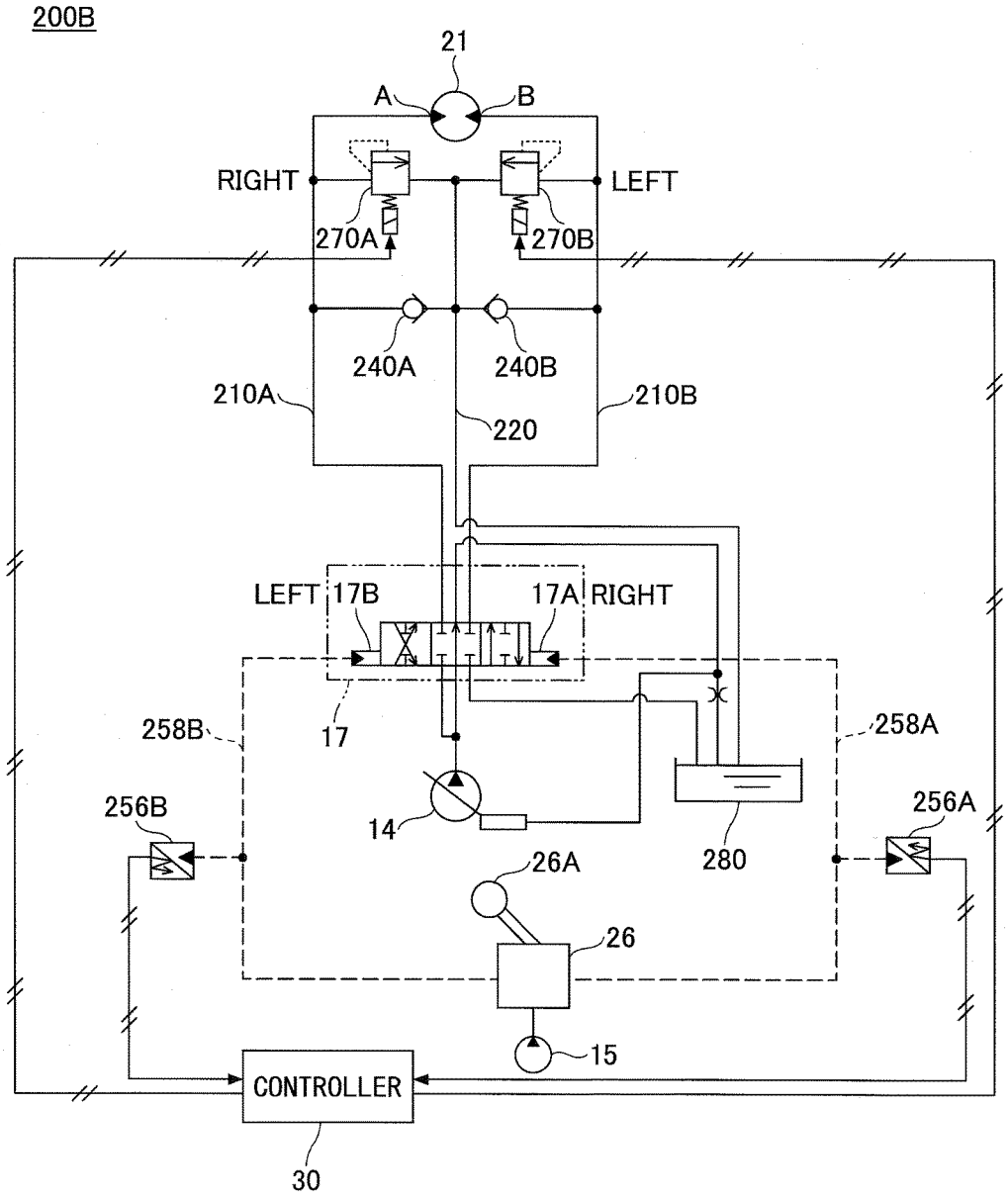
FIG. 7 is a hydraulic circuit diagram of a turning control apparatus according to a further example.

A description will now be given, with reference to FIG. 7, of a turning control apparatus 200B according to another example. FIG. 7 is a circuit diagram of a hydraulic circuit of the turning control apparatus 200B according to another example.

In the hydraulic circuit of the turning control apparatus 200B illustrated in FIG. 7, the functions of the low-pressure relief valves 260A and 260B and the functions of the high-pressure relief valves 230A and 230B in the turning control apparatus 100A illustrated in FIG. 5 are combined and incorporated into two-stage relief valves 270A and 270B, respectively. In FIG. 7, parts that are the same as the parts illustrated in FIG. 5 are given the same reference numerals, and descriptions thereof will be omitted.

In the above-mentioned structure, each of the high-pressure relief valves 230A and 230B, which are originally provided in the drive hydraulic circuit of the turning hydraulic motor 21, is configured to be a two-stage relief valve in order to, for example, suppress rising of the hydraulic pressure at the B-port when decelerating in rightward turning, thereby suppressing rapid deceleration of the upper turning-body 3 and suppressing occurrence of the hunting phenomenon. The change over of the relief pressures of each of the two-stage relief valves 270A and 270B is controlled by a signal supplied by the controller 30. For example, when a detection signal is supplied from the switch 256A to the controller 30, it is judged that the hydraulic pressure at the B-port rapidly rises. Thus, the controller 30 sends a change-over signal to the two-stage relief valve 270B at the time t1 in order to activate the low-pressure relief function so that the two-stage relief valve 270B can operate at a low-pressure relief pressure such as the relief pressure of the above-mentioned low-pressure relief valve 260B illustrated in FIG. 5, which is lower than the high-pressure relief pressure. When the turning operation lever 26A is operated at the time t1, a signal is supplied to the two-stage relief valve 270B on the deceleration side, and the low-pressure relief function is set in an ON state (the low-pressure relief function is activated). Accordingly, if the hydraulic pressure at the B-port exceeds the low-pressure relief pressure, the operating oil is returned to the tank 280 through the makeup hydraulic line 220. Thereby, even if the driver operates the turning operation lever 26A toward the neutral position or the half position at the time t3 or t6, the hunting phenomenon is suppressed from occurring.

Figure 8:
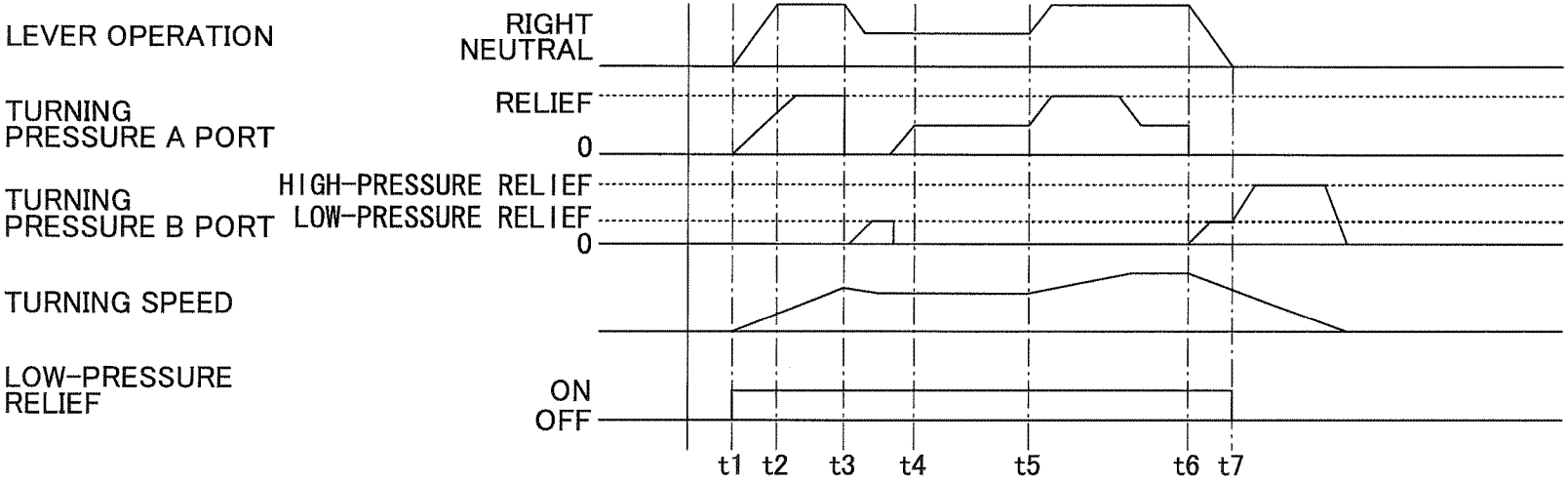
FIG. 8 is a time chart indicating hydraulic pressure changes at a turning hydraulic motor when an operator performs the same operation as the operation of the turning operation lever illustrated in FIG. 4A in a case where the turning control apparatus according to the further example is provided.

When the turning operation lever 26A is returned to the neutral position at the time t7, no signal is supplied to the two-stage relief valve 270B, which results in deactivation of the low-pressure relief function. Accordingly, the hydraulic pressure at the B-port rises from the low-pressure relief pressure and reaches the high-pressure relief pressure. As mentioned above, occurrence of a vibration can be suppressed at the time of stop turning. At this time, as illustrated in FIG. 8, the changes in the hydraulic pressure at the B-port of the turning hydraulic motor 21 are the same as the changes illustrated in FIG. 6.

As mentioned above, in the present example, the low-pressure relief function of the two-stage relief valve 270A and the makeup hydraulic line 220 together constitute a hunting reduction circuit. Similarly, the low-pressure relief function of the two-stage relief valve 270B and the makeup hydraulic line 220 together constitute a hunting reduction circuit.

In the above-mentioned examples, no hydraulic pressure is generated at the A-port and B-port of the turning hydraulic motor 21 when the shovel is installed on a horizontal ground and no hydraulic pressure is supplied from the control valve 17 to the turning hydraulic motor 21. Here, in a case where the shovel is installed on a sloped ground and when the position of center of gravity of the upper turning-body 3 differs from the position of the center of turning of the upper turning-body 3, there may be a case where a turning force is exerted on the upper turning-body 3 to cause the center of gravity to move downward along the slope, thereby causing hydraulic pressure to be generated at the A-port or B-port of the turning hydraulic motor 21.

If a normal control is performed and when the turning operation lever 26A is at the neutral position (that is, no turning operation is applied), a state is set where both the hydraulic line 210A connected to the A-port and the hydraulic line 210B connected to the B-port are blocked off, which results in braking applied by the turning hydraulic motor 210 in both leftward and rightward turning directions.

Even when the shovel is installed on a sloped surface, braking is applied to the upper turning-body 3 by the turning hydraulic motor 21 in both the leftward and rightward directions so that the upper turning-body 3 cannot turn. However, if the turning operation lever 26A is operated slightly in a case where the shovel equipped with the above mentioned turning control apparatus is installed on a sloped surface and a turning force is generated in the upper turning-body 3, there may be a case where the upper turning-body 3 turns along the slope against the driver's intention.

Specifically, consideration is given of a case where the shovel equipped with, for example, the turning control apparatus illustrated in FIG. 3 is installed on a sloped ground where a turning force is applied to the upper turning-body 3 in the rightward direction. In such a case, if the turning operation lever 26A is at the neutral position and the upper turning-body 3 is not operated for turning, the hydraulic pressure at the B-port of the turning hydraulic motor 21 is risen according to the turning force applied to the upper turning-body 3 due to the position of the shovel installed on the slope. In this state, if the turning operation lever 26A is slightly operated in the rightward direction and then immediately returned to the neutral position, hydraulic pressure is supplied to the A-port of the turning hydraulic motor 21 and simultaneously the open-close valve 252B, which is connected to the B-port through the hydraulic line 210B and the hydraulic line 250B, is opened. When the open/close valve 252B is opened, the hydraulic pressure at the B-port is reduced, and if the hydraulic pressure at the A-port exceeds the hydraulic pressure at the B-port in association with rising of the hydraulic pressure at the A-port, the upper turning-body 3 starts to make right turn.

However, if an operation of the turning operation lever 26A to return to the half position (neutral position) immediately after the upper turning-body 3 starts to make right turn, the hydraulic pressure at the A-port is decreased but a braking pressure cannot be generated at the B-port because the open/close valve 252B is still open. Thus, the turning hydraulic motor 21 cannot support the weight of the upper turning-body 3, and the upper turning-body 3 makes right turn along the slope until the driver returns the turning operation lever 26A to the neutral position.

Figure 9:
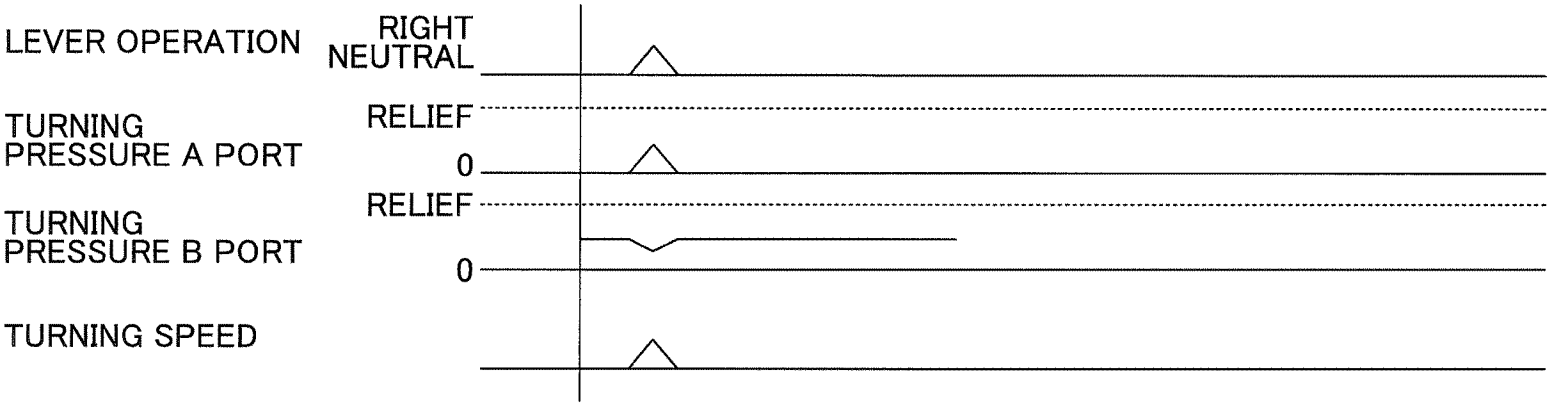
FIG. 9 is a time chart indicating hydraulic pressure changes at the turning hydraulic motor when the turning operation lever is operated slightly when the shovel is installed on a sloping ground.

In order to prevent such an unintentional turning of the upper turning-body 3, it is desirable to control not to open the open/close valves 252A and 252B when the shovel is installed on a sloped ground. For example, if the detection signal is output from either one of the switches 256A and 256B when the turning operation lever 26A is not operated, the controller 30 judges that the shovel is installed on a sloped ground, and controls the open/close valves 252A and 252B not to open even if the turning operation lever 26A is operated. Thus, as illustrated in FIG. 9, the hydraulic pressure at the B-port of the turning hydraulic motor 21 rises again when the turning operation lever 26A is returned to the neutral position, which returns to the state where braking is applied by the turning hydraulic motor 21 so that the upper turning-body 3 does not turn due to the inclination.

It should be noted that the determination of whether the shovel is installed on a sloped ground may be made based on a signal output from an inclination sensor 32 provided in the shovel. That is, the controller 30 may control the open/close valves 252A and 252B not to open even if the turning operation lever 26A is operated in a case where an inclination angle detected by the inclination sensor 32 is larger than a predetermined value. Additionally, a degree of inclination may be detected not only by the inclination angle but also detected based on a detection value of a hydraulic sensor provided in the hydraulic lines 210A and 210B.

All examples and conditional language recited herein are intended for pedagogical purposes to aid the reader in understanding the principles of the invention and the concepts contributed by the inventor to furthering the art, and are to be construed a being without limitation to such specifically recited examples and conditions, nor does the organization of such examples in the specification relates to a showing of the superiority and inferiority of the invention. Although the example(s) of the present invention (s) has (have) been described in detail, it should be understood that the various changes, substitutions, and alterations could be made hereto without departing from the spirit and scope of the invention.

What is claimed is:

1. A turning control apparatus comprising:

a turning body;

a hydraulic motor to turn the turning body;

a high-pressure relief circuit that includes a high-pressure relief valve so as to relieve a hydraulic pressure of a first hydraulic line at a first relief pressure, the first hydraulic line supplying an operating oil to drive the hydraulic motor; and a hunting reduction circuit that includes an open/close valve so as to relieve a hydraulic pressure of a second hydraulic line at a pressure lower than the first relief pressure, the second hydraulic line being connected to a deceleration-side hydraulic port of the hydraulic motor from which the operating oil is discharged when the hydraulic motor is being driven, wherein the hunting reduction circuit connected to the deceleration-side hydraulic port is caused to open before an operation lever, which is moved to a first position to turn the turning body, returns to a neutral position from the first position, wherein the hunting reduction circuit connected to the deceleration-side hydraulic port is caused to open at a second position that is between the first position and the neutral position, the movement of the operation lever triggering the opening of the hunting reduction circuit while the hydraulic motor is decelerating, and wherein, when a degree of inclination of an operating machine including the turning control apparatus detected by an inclination sensor is larger than a predetermined degree of the inclination, the hunting reduction circuit is configured to be closed and a state where the hunting reduction circuit is closed is configured to be maintained irrespective of an operation performed on the operation lever.

2. The turning control apparatus as claimed in claim 1, wherein the hunting reduction circuit further includes an orifice having a predetermined flow resistance.

3. The turning control apparatus as claimed in claim 1, wherein, when the turning body is judged to be installed on a slope, the hunting reduction circuit is maintained in a closed position.

4. A turning control apparatus comprising:

a turning body;

a hydraulic motor to turn the turning body;

a high-pressure relief circuit that includes a high-pressure relief valve so as to relieve a hydraulic pressure of a first hydraulic line at a first relief pressure, the first hydraulic line supplying an operating oil to drive the hydraulic motor; and a hunting reduction circuit that includes an open/close valve so as to relieve a hydraulic pressure of a second hydraulic line at a pressure lower than the first relief pressure, the second hydraulic line being connected to a deceleration-side hydraulic port of the hydraulic motor from which the operating oil is discharged when the hydraulic motor is being driven, wherein the hunting reduction circuit connected to the deceleration-side hydraulic port is caused to open before an operation lever, which is moved to a first position to turn the turning body, returns to a neutral position from the first position, wherein the hunting reduction circuit connected to the deceleration-side hydraulic port is caused to open at a second position that is between the first position and the neutral position, the movement of the operation lever triggering the opening of the hunting reduction circuit while the hydraulic motor is decelerating, and wherein the hunting reduction circuit further includes a low-pressure relief valve operable at a second relief pressure lower than the first relief pressure.

5. A turning control apparatus comprising:

a turning body;

a hydraulic motor to turn the turning body; and a high-pressure relief circuit that includes a two-stage relief valve so as to relieve a hydraulic pressure of a first hydraulic line at a first relief pressure and relieve a hydraulic pressure of the first hydraulic line at a pressure lower than the first relief pressure, the first hydraulic line supplying an operating oil to drive the hydraulic motor, the first hydraulic line being connected to a deceleration-side hydraulic port of the hydraulic motor from which the operating oil is discharged when the hydraulic motor is being driven, wherein the high-pressure relief circuit connected to the deceleration-side hydraulic port is caused to open before an operation lever, which is moved to a first position to turn the turning body, returns to a neutral position from the first position, wherein the high-pressure relief circuit connected to the deceleration-side hydraulic port is caused to open at a second position that is between the first position and the neutral position, the movement of the operation lever triggering the opening of the high-pressure relief circuit while the hydraulic motor is decelerating, wherein the two-stage relief valve is formed by incorporating a function of low-pressure relief functioning at a second relief pressure lower than the first relief pressure.

6. A turning control apparatus comprising:

a turning body;

a hydraulic motor to turn the turning body;

a high-pressure relief circuit that includes a high-pressure relief valve so as to relieve a hydraulic pressure of a first hydraulic line at a first relief pressure, the first hydraulic line supplying an operating oil to drive the hydraulic motor; and a hunting reduction circuit that includes an open/close valve so as to relieve a hydraulic pressure of a second hydraulic line at a pressure lower than the first relief pressure, the second hydraulic line being connected to a deceleration-side hydraulic port of the hydraulic motor from which the operating oil is discharged when the hydraulic motor is being driven, wherein the hunting reduction circuit connected to the deceleration-side hydraulic port is caused to open before an operation lever, which is moved to a first position to turn the turning body, returns to a neutral position from the first position, wherein the hunting reduction circuit connected to the deceleration-side hydraulic port is caused to open at a second position that is between the first position and the neutral position, the movement of the operation lever triggering the opening of the hunting reduction circuit while the hydraulic motor is decelerating, and wherein the hunting reduction circuit further includes an orifice having a predetermined flow resistance that generates a second relief pressure lower than the first relief pressure.

7. A turning control apparatus comprising:

a turning body;

a hydraulic motor to turn the turning body;

a high-pressure relief circuit that includes a high-pressure relief valve so as to relieve a hydraulic pressure of a first hydraulic line at a first relief pressure, the first hydraulic line supplying an operating oil to drive the hydraulic motor; and a hunting reduction circuit that relieves a hydraulic pressure of a second hydraulic line at a pressure lower than the first relief pressure, the second hydraulic line being connected to a deceleration-side hydraulic port of the hydraulic motor from which the operating oil is discharged when the hydraulic motor is being driven, wherein the hunting reduction circuit connected to the deceleration-side hydraulic port is caused to open before an operation lever, which is moved to a first position to turn the turning body, returns to a neutral position from the first position, wherein the hunting reduction circuit connected to the deceleration-side hydraulic port is caused to open at a second position that is between the first position and the neutral position, the movement of the operation lever triggering the opening of the hunting reduction circuit while the hydraulic motor is decelerating, and wherein the hunting reduction circuit further includes a low-pressure relief valve operable at a second relief pressure lower than the first relief pressure.

* * * * *